United States Patent [19]

Thoma et al.

[11] Patent Number: 4,599,148

[45] Date of Patent: Jul. 8, 1986

[54] GALVANICALLY DEPOSITED DISPERSION LAYER AND METHOD FOR MAKING SUCH LAYER

[75] Inventors: Martin Thoma; Paul Bünger, both of Munich, Fed. Rep. of Germany

[73] Assignee: MTU Motoren-und Turbinen-Union Muenchen GmbH, Munich, Fed. Rep. of Germany

[21] Appl. No.: 788,755

[22] Filed: Oct. 18, 1985

Related U.S. Application Data

[62] Division of Ser. No. 592,851, Mar. 23, 1984.

[30] Foreign Application Priority Data

Jul. 29, 1983 [DE] Fed. Rep. of Germany ..... 3327346

[51] Int. Cl.[4] ..... C25D 15/00

[52] U.S. Cl. ..... 204/16

[58] Field of Search ..... 204/16

[56] References Cited

U.S. PATENT DOCUMENTS 3,929,590 12/1975 Heyes ..... 204/16

4,305,792 12/1981 Kedward ..... 204/16

FOREIGN PATENT DOCUMENTS 1358538 7/1974 United Kingdom ..... 204/16

*Primary Examiner*—T. M. Tufariello

*Attorney, Agent, or Firm*—W. G. Fasse; D. H. Kane, Jr.

[57] ABSTRACT

A wear and tear protection is achieved by a galvanically deposited coating on at least one of two structural components cooperating in a wear zone. The coating is a dispersion layer having a cobalt matrix and chromic oxide ($Cr_2O_3$) particles embedded in the cobalt matrix. The protective layer is produced with the aid of an electrolytic dispersion bath in which the chromic oxide particles are dispersed.

9 Claims, 2 Drawing Figures

GALVANICALLY DEPOSITED DISPERSION LAYER AND METHOD FOR MAKING SUCH LAYER

Figure 1:
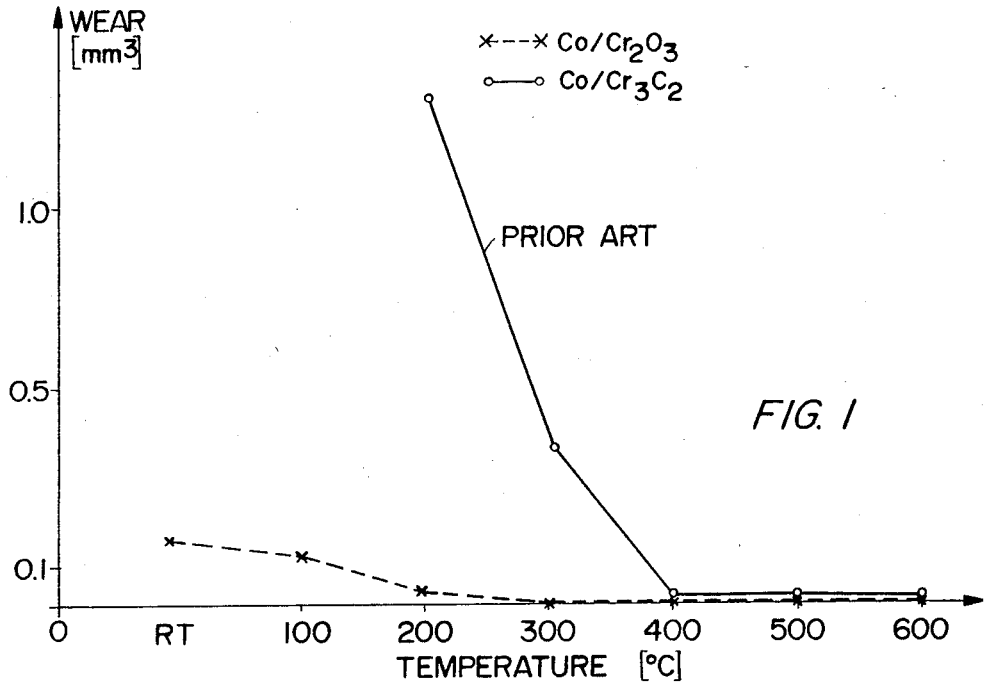

This is a divisional of application Ser. No. 592,851 filed Mar. 23, 1984.

FIELD OF THE INVENTION

The invention relates to a galvanically deposited dispersion layer and to a method of producing such a layer including a cobalt matrix with a non-metallic dispersion phase embedded in such a layer.

DESCRIPTION OF THE PRIOR ART

British Pat. No. 1,358,538 discloses layers of the type mentioned above in which a cobalt matrix has embedded therein a phase of hard materials such as chromium carbide, tungsten carbide, or silicon carbide. It has been discovered that such dispersion layers are suitable to function as wear protection layers on structural components exposed to temperature loads, for example in turbo-engines. The ability of these layers to provide a wear protection is due to their large hardness and also due to the fact that it is possible to produce the protective layer by a chemical deposition even on structural components having a complicated shape. Comparative tests of such layers have shown that a system cobalt/-chromium carbide exhibits rather low wear and tear values in a temperature range of about 400° C. to 600° C. due to frictional corrosion. This disadvantage appears to be due to the fact that in the known cobalt chrome carbide system in which the chrome carbide phase is embedded in a cobalt matrix, the heat treatment that follows the galvanic deposition for achieving a diffusion, causes a decomposition of the chromium carbide, thereby producing a complex chromium-cobalt-carbide system. Further, the use of chromium carbide poses certain difficulties because it has a relatively high specific weight which requires special steps for keeping the chromium carbide particles suspended in a uniform distribution throughout an electrolytic bath. Further, a disadvantage is seen in that the chromium carbide has a relatively good electrical conductivity resulting in a dendritic growth in the deposited layer or coating.

OBJECTS OF THE INVENTION

In view of the above it is the aim of the invention to achieve the following objects singly or in combination:

to avoid the disadvantages of the prior art, specifically to provide a wear resistant dispersion layer which has a higher resistance relative to fretting corrosion than prior art dispersion layers;

to provide a dispersion layer which is effective already in a temperature range starting at about 200° C. to about 300° C.;

the production of the layer shall require a simple production method;

the layer shall be heat treatable subsequent to the dispersion deposition without any disadvantages resulting from such heat treatment to make the protection layer also suitable for temperature ranges above 300° C.; and to make sure that the heat treatment does not cause any reaction of the matrix metal with the embedded solid material particles.

SUMMARY OF THE INVENTION

According to the invention the galvanically deposited dispersion layer comprises an oxidized cobalt matrix having embedded therein a dispersion phase of chromic oxide particles ($Cr_2O_3$). It has been found that the chromic oxide particles are resistant to oxidation and also temperature resistant so that the heat treatment subsequent to the galvanic deposition does not cause any reaction between the cobalt and the chromic oxide particles.

According to the invention there is also provided a method for producing a protective layer as disclosed herein. Such method according to the invention involves suspending the disperse phase in the form of chromic oxide particles in an electrolyte also containing cobalt ions. Such electrolyte has a pH-value in the range of about 4.5 to 4.9 and the galvanic deposition is performed in a temperature range of about 40° C. to about 60° C., preferably at about 50° C. at a current density in the range of 1 amp/dm$^2$ to 6 amps/dm$^2$. Preferably, the current density is maintained at about 3.5 amps/dm$^2$. It has been found that performing the present method resulted in protective layers which have excellent characteristics as far as their homogenity and their bonding strength on a substrate is concerned.

BRIEF FIGURE DESCRIPTION

Figure 2:
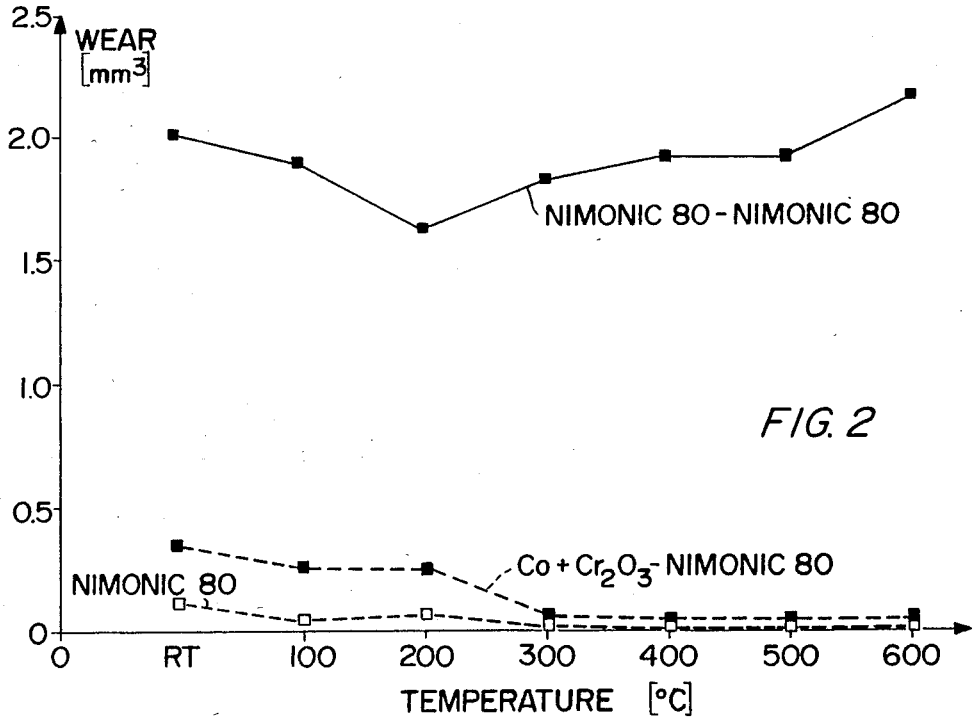

In order that the invention may be clearly understood, it will now be described, with reference to the accompanying drawings, wherein:

FIG. 1 shows the wear in cubic millimeters (mm$^3$) of two structural components cooperating as a pair, as a function of the operating temperature, and comparing the prior art with the invention; and FIG. 2 is also a diagram showing the wear as a function of temperature, comparing an unprotected pair of structural components with a pair of structural components, one member of the pair of which is protected by a layer according to the invention.

DETAILED DESCRIPTION OF PREFERRED EXAMPLE EMBODIMENTS AND OF THE BEST MODE OF THE INVENTION

An electrolytic bath suitable for performing the present method is an aqueous solution having the following composition:

430 to 470 grams/liter of cobalt sulfate ($CoSO_4 \cdot 6H_2O$),
15 to 20 grams/liter of sodium chloride (NaCl), and
25 to 30 grams/liter of boric acid ($H_3BO_3$).

The layer produced with a bath as described above is preferably subjected to a thermal treatment for oxidizing the cobalt matrix. Such oxidizing changes the cobalt of the matrix to $Co_3O_4$/CoO and such oxidation is influenced by the chromic oxide ($Cr_2O_3$) embedded in the cobalt matrix. Contrary to the oxidation of pure cobalt, the oxide layers resulting according to the invention are thinner and have a very good bonding strength relative to the substrate. As a result, the bonding strength of the oxide layer can be substantially increased. Preferably, the heat treatment takes place at a temperature within the range of about 500° C. to about 700° C. for a time duration of about seven to nine hours. The optimal conditions have been found to be present at 600° C. and a duration of eight hours.

It has been found that an optimal wear resistant against frictional or fretting corrosion in structural components for thermal turbo-engines may be accomplished if the dispersion layer is deposited to a layer or coating thickness in the range of about 10 to about 300 μm. Further, with regard to the features of the present layers it has been found that the optimal wear resistant values are obtained if the embedding rate of the disperse phase is within the range of about 20 to 50% by volume, preferably 30% by volume of the layer material. The particle size of the chromic oxide particles should be below 10 μm, preferably within the range of 3 to 6 μm.

The invention is especially useful in connection with structural components cooperating as a pair under wear and tear conditions, especially frictional or fretting corrosion conditions. It has been found that such structural components cooperating as a pair should be made of a basic nickel alloy or of a basic titanium alloy to form the substrate for the protective layer. Nickel alloys known as Inconel 100*, or C263*, or Nimonic 80* have been found to be suitable for the present purposes. A basic titanium alloy* suitable for the present purposes may comprise 6% by weight of aluminum, 5% by weight of zirconium, 0.8% by weignt of molybdenum, 0.2% by weight of silicon, and the remainder being titanium. Chromium steels* or chromium nickel steels are also suitable for forming the structural components on which the present layers are deposited.

*Composition of suitable alloys disclosed in "Werkstoff-Leistungsblatt" MTN 12202, MTN 12216, MTN 12224, MTN 12186 and MTN 12377 as attached.

As will be explained in more detail below with reference to FIG. 2, it has been found that the application of a cobalt/chromic oxide dispersion layer on only one structural component of a pair also reduces the wear and tear on the other structural component not provided with a protective layer. Such reduction resulting in a minimal wear and tear.

Both curves in FIG. 1 illustrate the wear in cubic millimeters of material removed as a result of the wear as a function of the operating temperature, whereby both curves represent the frictional or fretting wear of two dispersion layers relative to each other. The full line curve represents the prior art and illustrates the wear of a dispersion layer comprising chromium carbide particles embedded in a cobalt matrix. The wear of the prior art protective layer is quite large, especially in the range between 200° and 400° C.

The wear of a protective coating according to the invention is shown by the dashed line representing a protective layer having chromic oxide particles embedded in a cobalt matrix by a dispersion deposition. It will be noted that especially in the temperature range between 200° and 300° C. the wear values of a dispersion layer according to the invention amount to only about one tenth to one fifth of the wear values for a prior art protective layer comprising chromium carbide in a matrix of cobalt. Incidentally, the full line curve representing the prior art is disclosed in the magazine "KOBALT" 1973, Volume 3, page 5, FIG. 4. In the temperature range of 400° to 600° C. the wear of a protective layer or coating according to the invention is slightly lower than that of a prior art protective coating.

FIG. 2 shows also a wear diagram, whereby the full line curve in the top portion of FIG. 2 shows the wear of two cooperating structural components both of which are made of a nickel alloy known under the tradename Nimonic 80. The two lower dashed line curves show the wear and tear of two structural components, one of which is provided with a protective coating according to the invention, formed as a dispersion layer of chromic oxide particles embedded in a cobalt matrix. The upper dashed line curve represents the wear, again in cubic millimeters as a function of the operating temperature, of the protective coating according to the invention. The lower dashed line curve shows the wear of the structural component surface made of Nimonic 80.

The tests on which the above curves are based show that the dispersion layer according to the invention has substantially improved, that is, lower wear values under the same test conditions as have been possible according to the prior art using cobalt chromium carbide compound layers as represented by the full line in FIG. 1. It is particularly advantageous that according to the invention the high wear resistance already occurs at temperatures of about 300° C. whereas in the prior art such high wear resistance only was possible at temperatures above 400° C. Even in the range of 200° C. to 300° C. the protective layer according to the invention shows a marked improvement in its wear resistance, that is, a marked reduction in the wear value.

Another advantage of the invention using chromic oxide particles in a cobalt matrix is seen in that it facilitates the production method because chromic oxide has a relatively low specific weight, whereby it is easy to keep it uniformly suspended in the electrolytic bath. Furthermore, another advantage resides in the fact that chromic oxide has a high specific electrical resistance to the extent that it can be considered to be electrically non-conducting, whereby the embedding mechanism is quite different from that of the prior art. More specifically, the embedding mechanism according to the invention avoids the formation of dendritic growth. Such growth is quite possible in the prior art protective layers comprising chromium carbide.

Although the invention has been described with reference to specific example embodiments, it will be appreciated, that it is intended to cover all modifications and equivalents within the scope of the appended claims.

What is claimed is:

1. A method for producing a galvanically deposited dispersion layer comprising a cobalt matrix and a nonmetallic dispersion phase of chromic oxide particles ($Cr_2O_3$) embedded in said cobalt matrix, comprising the following steps:

(a) preparing an electrolytic bath having a cobalt ion content, (b) suspending chromic oxide particles in said electrolytic bath, (c) adjusting the pH-value of the electrolytic bath to be within the range of 4.5 to 4.9, (d) operating the bath at a temperature within the range of 40° C. to 60° C., and (e) adjusting the current density to a value within the range of 1 amp/dm$^2$ to 6 amps/dm$^2$ for depositing said dispersion layer with the chromic oxide particles embedded in said cobalt matrix on a structural component.

2. The method of claim 1, wherein said step of preparing said electrolytic bath comprises preparing an aqueous solution of the following ingredients:

(a) 430 to 470 grams/liter of cobalt sulfate ($CoSO_4 \cdot 6H_2O$), (b) 15 to 20 grams/liter of sodium chloride (NaCl), and (c) 25 to 30 grams/liter of boric acid ($H_3BO_3$).

3. The method of claim 1, further comprising subjecting said galvanically deposited layer to a heat treatment at a temperature and duration sufficient for an intended oxidation of said cobalt matrix.

4. The method of claim 3, wherein said heat treatment is performed at a temperature within the range of about 500° C. to about 700° C. for a duration of about seven to nine hours.

5. The method of claim 1, wherein said layer is deposited on a structural component subject to wear and made of a nickel alloy.

6. The method of claim 1, wherein said layer is deposited on a structural component subject to wear and made of a titanium alloy.

7. The method of claim 6, wherein said titanium alloy comprises the following composition:

6% by weight, of aluminum,
5% by weight, of zirconium,
0.8% by weight, of molybdenum,
0.2% by weight, of silicon, and
the remainder being titanium.

8. The method of claim 1, wherein said electrolytic bath is operated at a temperature of about 50° C.

9. The method of claim 1, wherein said current density is adjusted to about 3.5 amps/dm$^2$.

* * * * *